United States Patent [19]

Lyons

[11] Patent Number: 4,786,121

[45] Date of Patent: Nov. 22, 1988

[54] COMPUTER PROTECTIVE ENCLOSURE

[76] Inventor: Charles D. Lyons, P.O. Box 29730, Elkins Park, Pa. 19117

[21] Appl. No.: 133,163

[22] Filed: Dec. 11, 1987

Related U.S. Application Data

[63] Continuation of Ser. No. 907,023, Sep. 15, 1986, abandoned.

[51] Int. Cl.[4] ..... A47B 81/00

[52] U.S. Cl. ..... 312/214; 248/316.7; 312/350

[58] Field of Search ..... 312/287

[56] References Cited

U.S. PATENT DOCUMENTS

| | | | |
|---|---|---|---|
| 2,271,250 | 1/1942 | Buchholz | 248/316.7 X |
| 3,550,978 | 12/1970 | Magee | 312/350 X |
| 4,376,558 | 3/1983 | Bandar | 312/314 X |

FOREIGN PATENT DOCUMENTS

| | | | |
|---|---|---|---|
| 109183 | 12/1939 | Australia | 312/286 |

*Primary Examiner*—Joseph Falk

*Attorney, Agent, or Firm*—Steele, Gould & Fried

[57] ABSTRACT

A protective enclosure for computers is disclosed which includes a base panel, a roof panel and sidewall right and left panels interconnecting the base and roof panels. The front of the enclosure is unobstructed to permit easy insertion of the computer into the enclosure and to facilitate access to the stored computer when in use. The interior of the sidewalls of the enclosure are lined with suitable insulating materials, which may be corrugated foam plastic, to acoustically isolate and additionally protect the stored computer. The enclosure is intended for affixing to building construction members or to pieces of furniture or other stationary objects to prevent movement of the enclosure and the enclosure stored computer.

1 Claim, 1 Drawing Sheet

COMPUTER PROTECTIVE ENCLOSURE

This is a continuation of application Ser. No. 907,023, filed Sept. 15, 1985 now abandoned.

BACKGROUND OF THE INVENTION

1. Field of the Invention:

This invention relates generally to the field of computer related furniture, and more particularly, is directed to a protective enclosure suitable for storing a computer in active arrangement within a protective environment.

2. Description of the Prior Art

It is the common practice in offices, commercial establishments and the like to employ one or more small personal computers to facilitate the operation and work progress of the office or other establishment. Such small computers as are now in use are generally placed upon the top of a desk or other working surface in a manner to readily permit the input of data and to allow the viewing and printout of the developed information in a relatively easy manner, responsive to the controls of the operator.

Workers in this field have found that their productivity has been hindered in many instances by the lack of available desktop space since it is the usual practice to place working papers, instructional documents, data sheets and the like which are to be used in conjunction with the computer operation directly upon the desk or table surface, in immediate juxtaposition to the computer. As a result of this common desktop clutter, sometimes it has been found desirable to remove one or more of the computer components from the top of the desk and to store these components in working arrangement at a location remote from the top of the desk. Quite often, the screen and the keyboard remained upon the desk top and the computer itself was removed from the top of the desk and placed in the vicinity of the desk in a position where it could be readily accessed by the computer operator, for example, the floor area immediately below or adjacent to the desk.

When such computers are regularly stored in exposed condition upon the floor, they are of course more prone to injury or damage in such a location than they previously were when installed on the desk itself. Experience has proven that inadvertent employees, cleaners and others who do not or cannot pay sufficient attention to floor mounted equipment can damage such equipment by unintentionally bumping, knocking or otherwise creating an impact upon the computer equipment. In view of the complexity of each equipment, its inherent value and the relatively high cost of repairs or replacement, anything that can be done to protect such exposed equipment will be of immediate financial benefit to the equipment owner.

In order to provide a degree of protection for remotely positioned computers, prior workers in the art have developed various types of equipment holders or brackets which are designed to maintain the stored computers in a relatively stable and safe manner both when in use and when the equipment is not being used. One such bracket has been manufactured and sold by Curtis Manufacturing Company for use with IBM PC type computers. Despite the efforts of the prior workers in the field, remotely located computers still remain in a relatively unsafe storage arrangement and the need still exists to provide an ipmroved remote computer storage system.

SUMMARY OF THE INVENTION

The present invention relates generally to computer protection devices, and more particularly, is directed to a floor mounted enclosure suitable for receiving, storing and protecting computers in a desktop remote location.

The computer protective enclosure of the present invention includes generally an enclosing cabinet in the nature of a protective enclosure having a base and side walls extending upwardly from the base, the said walls terminating upwardly in an enclosing top. In the preferred embodiment, the front of the protective cabinet is designed to always be open to permit insertion of the computer, to facilitate easy access to the front of the computer for computer operational purposes and to allow the free circulation of air in a manner to dissipate any heat that may be generated as a result of the computer operation.

The protective enclosure is inwardly lined with sheets of a suitable insulting material to provide additional protection for the computer, as well as for sound deadening and acoustical isolation. Preferably, the interior insulating materials cover the entire interior surfaces of the enclosure side walls. The base itself need not be covered or otherwise protected to facilitate the sliding insertion and removal of the computer into and out of the protective enclosure. In the preferred embodiment, the side wall insulation materials extend downwardly from the enclosure top and terminate a small distance above the protective enclosure floor in a manner to provide lateral clearance spaces to facilitate insertion and removal of the remotely located computer together with its supporting bracket.

The protective enclosure as designed may be affixed directly to the computer desk or table or to other furniture, equipment, or building construction member which is generally stationary in concept and construction whereby the computer protective enclosure will be so installed as to discourage removal, overturning or any other deleterious movement. In most instances, it may be helpful to releasably secure the protective enclosure in a known manner to allow access to the computer for service requirements. While the computer is movable relative to the computer protective enclosure, it is an object of this invention to affix the protective enclosure itself whereby the computer will be shielded from damage even when being positioned above floor level. Additionally, it is contemplated that the computer protective enclosure may be constructed as a separate, stable, free standing unit that could adequately protect the computer stored therewithin without the need to attach the protective enclosure to any other item of furniture or building construction.

It is therefore an object of the present invention to provide an improved computer protective enclosure of the type set forth.

It is another object of the present invention to provide a novel computer protective enclosure that is suitable for installation at floor level and which is designed for attachment to a permanently installed fixture or piece of furniture.

It is another object of the present invention to provide a novel computer protective enclosure that comprises a sturdy enclosure including a base, a top and opposed side walls extending from the base to the top in a manner to define a hollow interior for receipt of a computer therewithin.

It is another object of the present invention to provide a novel computer protective enclosure comprising a sturdy enclosure suitable for floor installation, the interior of the enclosure being lined with a covering of insulating materials, the base of the enclosure being adapted to slidingly receive the computer thereon, the computer protective base not being covered with the insulating material.

It is another object of the present invention to provide a novel computer protector or protective enclosure which includes a partially insulated enclosure, the base of the protective enclosure not being covered with any insulation, a metallic or other sturdy material bracket slidable upon the floor within the enclosure, the bracket being configured and adapted to receive and secure thereon a computer in a secure, safe and workable manner.

It is another object of the present invention to provide a novel computer protective enclosure that is simple in design, inexpensive in manufacturer and trouble free when in use.

Other objects and a fuller understanding of the invention will be had by referring to the following description and claims of a preferred embodiment, taken in conjunction with the accompanying drawings wherein like reference characters refer to similar parts throughout the several views and in which:

DESCRIPTION OF THE PREFERRED EMBODIMENT OF THE INVENTION

Figure 2:
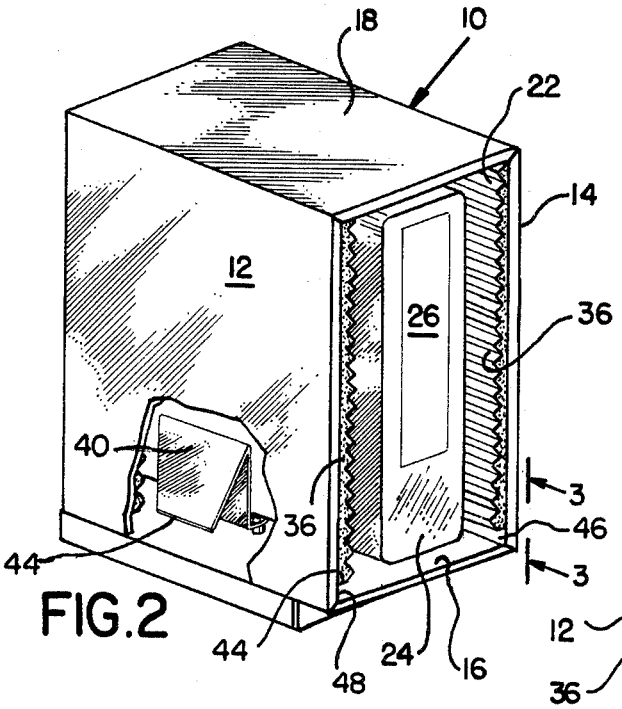
FIG. 2 is a perspective view showing the computer in protected storage within the protective enclosure, and partially broken away to expose interior construction features.

Although specific terms are used in the following description for the sake of clarity, these terms are intended to refer only to the particular structure of the invention selected for illustration in the drawings, and are not intended to define or limit the scope of the invention.

Figure 1:
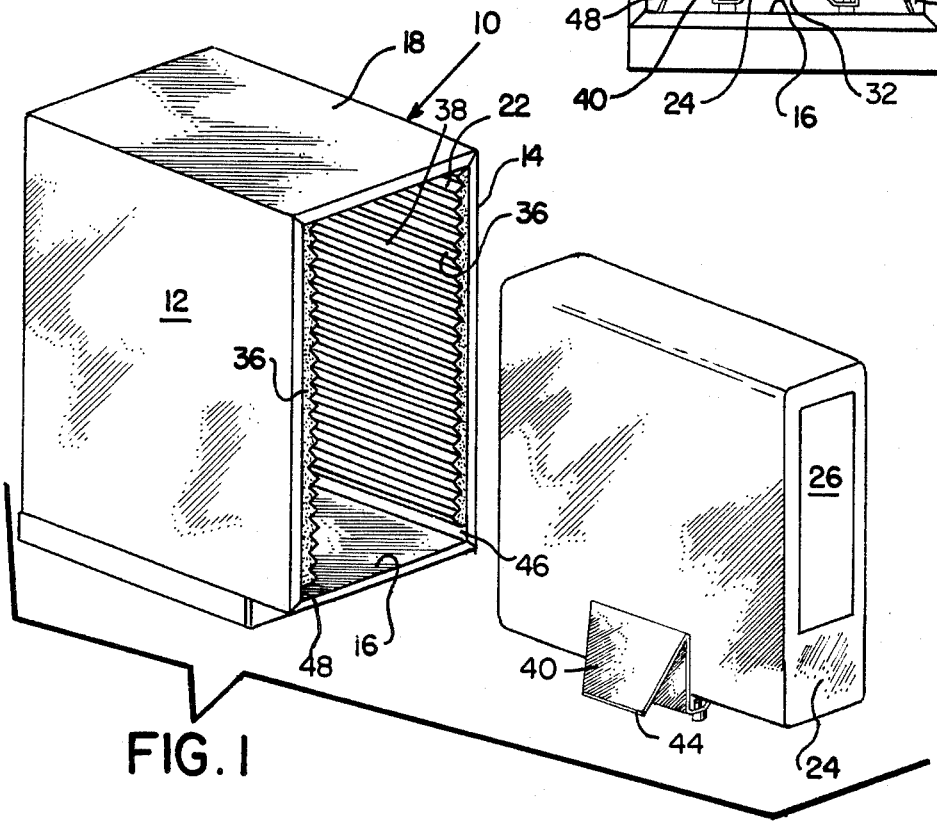
FIG. 1 is a perspective view of a computer protective enclosure constructed in accordance with the teachings of the present invention and showing a computer and associated mounting bracket in exploded relationship.

Referring now to the drawings, there is shown in FIGS. 1 and 2 a protective enclosure or computer protector 10 suitable for mounting upon a level, sturdy surface, for example a floor. The protective enclosure 10 comprises generally an equipment enclosure defined by left and right sidewall panels 12, 14, a floor or base panel 16 and a roof or a top panel 18. A rear panel is not required and should not be employed to allow for proper air flow and full cable accessibility. The front 22 remains open and uncovered to facilitate easy insertion and removal of a computer 24 when so desired and to facilitate complete access to the computer front or face 26 by the operator when the computer is in use. It is contemplated that the enclosure panels will be fabricated of usual construction materials commonly employed for constructing office furniture, such as wood, plastic and metal and combinations thereof.

Figure 3:
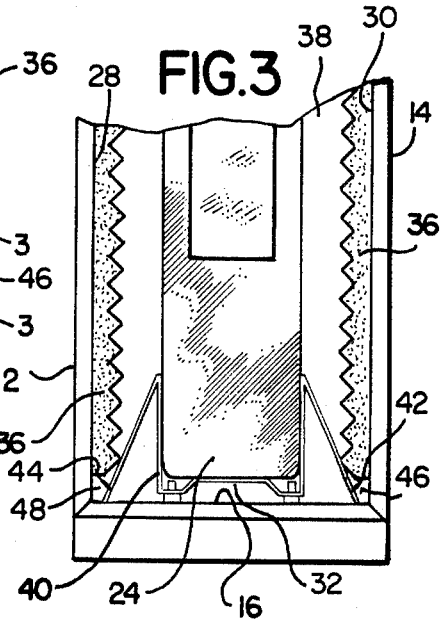
FIG. 3 is an enlarged, partial, front elevational view looking from line 3—3 on FIG. 2.

Preferably, the interior surfaces 28, 30 of the respective left and right sidewalls 12, 14 are substantially completely covered with a suitable insulating material 36 to acoustically and protectively shield the computer 24 when the computer is positioned witin the insulated interior 38 of the equipment protective enclosure 10 in the manner illustrated in FIGS. 1 and 2. As shown in FIGS. 1 and 3, the insulating materials employed can be fabricated of a suitable foam plastic or foam rubber of known composition to a corrugated configuration. As illustrated, the corrugations extend from the front to rear of the enclosure to provide a plurality of furrows or air channels for sound and heat dissipation and equipment protection purposes. The furrows are defined by alternating ridges and valleys, which ridges project interiorly of the enclosure.

Referring still to FIGS. 1 and 3, it will be seen that a movable, metallic bracket 40 of known design is utilized to securely support the computer 24 within the protective enclosure 10. The metallic bracket includes a base 32 and laterally extending spring sides or feet 42, 44 to provide additional stability to the supported structure after it has been removed from the desktop (not shown). The bracket feet 42, 44 extend transversely substantially the entire width of the protective cabinet 10 and terminate laterally respectively near the base of each of the left and right sidewalls 12, 14.

As best seen in FIG. 1 and FIG. 3, the insulating materials 36 which line the left sidewall 12 and the right sidewall 14 extend completely from the enclosure top panel 18 and terminate a short distance above the floor panel 16 to thereby define laterally opposed, left and right bottom track areas 46, 48. The bottom track areas 46, 48 are provided to define lateral clearance spaces to allow the extremities of the metallic bracket feet 42, 44 to be positioned therewithin and to slide along the tracks as the computer 24 is maneuvered into and removed from the insulated interior 38 defined within the enclosing panels of the equipment protective enclosure 10.

In use, it is contemplated that the dimensions and configuration of the various panels 12, 14, 16 and 18 which define the computer protective enclosure 10 will be so designed as to provide considerable stability when the computer 24 is installed therewithin to thereby discourage easy tipping or movement and accordingly to prevent damage or other injury to the computer 24 itself. Additionally, to further assure that the equipment protective enclosure 10 will not be toppled, moved or otherwise dislodged, it is preferred that the protective enclosure 10 be secured to a fixed construction (not shown) of the building wherein the equipment is to be used or to a stationary piece of furniture, for example, the computer terminal table (also not shown) which is normally provided and utilized in conjunction with computer operation. The interconnections between the protective enclosure 10 and the building construction or other furniture can be made with usual fasteners in the usual manner as may be necessary, depending upon local conditions in a manner to provide for enclosure release when desired.

Although the invention has been described with a certain degree of particularity, it is understod that the present disclosure has been made only by way of example and that numerous changes in the details of construction and the combination and arrangement of parts may be resorted to without departing from the spirit and scope of the invention.

What is claimed is:

1. A protection enclosure for computers comprising a stationary protector, the protector being defined by a base panel, a roof panel and right and left sidewall panels extending from the base panel to the roof panel, the base, roof and right and left sidewall panels defining a hollow interior of size and configuration to receive a computer therein, the right and left sidewall panels each comprising interior surfaces, the protector having an open front to permit easy access to the computer when stored within the enclosure, the protector having an open back to allow air to flow through the said hollow interior;

insulation materials lining discrete interior portions of the hollow of the enclosure, the insulation material being affixed to the interior surfaces of the right and left sidewall panels, the insulation material substantially covering the interior surfaces of the right and left sidewall panels, the insulation covering the right and left sidewall panels defining a clearance space there between sufficient to receive a computer therein, the insulation material extending downwardly from the roof panel and terminating a short distance above the base panel, the insulation material defining laterally opposed, left and right track areas above the base panel at the interconnections between the floor panel and the left and right sidewall panels, the left and right track areas comprising uninsulated bottom portion of the left and right sidewall panels; and a movable computer supporting bracket in sliding contact with the base panel, the movable bracket comprising a base and integral left and right feet, the feet being spaced apart by a distance that is less than the distance between the left and right sidewalls panels, the feet being spaced apart by a distance that is greater than the width of the said clearance space, at least one of the bracket feet being positioned within one of the track areas to permit the bracket feet to slide within the track area; whereby the insertion and withdrawal of a computer into and out of the enclosure can be facilitated.

* * * * *